US008171736B2

(12) United States Patent
Hawie et al.

(10) Patent No.: US 8,171,736 B2
(45) Date of Patent: May 8, 2012

(54) COMBUSTOR WITH CHAMFERED DOME

(75) Inventors: Eduardo Hawie, Woodbridge (CA); Robert Sze, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 1266 days.

(21) Appl. No.: 11/668,773

(22) Filed: Jan. 30, 2007

(65) Prior Publication Data

US 2008/0178599 A1 Jul. 31, 2008

(51) Int. Cl.
*F02C 1/00* (2006.01)

(52) U.S. Cl. ..... 60/752; 60/804

(58) Field of Classification Search ..... 60/752, 60/756, 757, 796, 804
See application file for complete search history.

(56) References Cited

U.S. PATENT DOCUMENTS

| | | | |
|---|---|---|---|
| 2,669,090 | A | 2/1954 | Jackson |
| 2,840,989 | A | 7/1958 | MacCauley |
| 3,098,357 | A | 7/1963 | Marsh |
| 3,169,367 | A | 2/1965 | Hussey |
| 3,608,309 | A | 9/1971 | Hill et al. |
| 3,916,619 | A | 11/1975 | Masai et al. |
| 3,995,422 | A | 12/1976 | Stamm |
| 4,195,476 | A | 4/1980 | Wood |
| 4,226,088 | A | 10/1980 | Tsukahara et al. |
| 4,246,757 | A | 1/1981 | Heberling |
| 4,329,848 | A | 5/1982 | Caruel et al. |
| 4,339,925 | A | 7/1982 | Eggmann et al. |
| 4,475,344 | A | 10/1984 | Mumford et al. |
| 4,497,170 | A | 2/1985 | Elliot et al. |
| 4,532,762 | A | 8/1985 | Mongia et al. |
| 4,549,402 | A | 10/1985 | Saintsbury et al. |
| 4,590,769 | A | 5/1986 | Lohmann et al. |
| 4,594,848 | A | 6/1986 | Mongia et al. |
| 4,702,073 | A | 10/1987 | Melconian |
| 4,773,593 | A | 9/1988 | Auxier et al. |
| 4,878,283 | A | 11/1989 | McLean |
| 4,949,545 | A | 8/1990 | Shekleton |
| 4,996,838 | A | 3/1991 | Melconian |
| 5,012,645 | A | 5/1991 | Reynolds |
| 5,117,637 | A | 6/1992 | Howell et al. |
| 5,129,231 | A | 7/1992 | Becker et al. |
| 5,142,871 | A | 9/1992 | Lampes et al. |
| 5,165,226 | A | 11/1992 | Newton et al. |
| 5,235,812 | A | 8/1993 | Klaass et al. |
| 5,241,827 | A | 9/1993 | Lampes |
| 5,265,425 | A | 11/1993 | Howell |
| 5,279,127 | A | 1/1994 | Napoli |
| 5,297,385 | A | 3/1994 | Dubell et al. |

(Continued)

FOREIGN PATENT DOCUMENTS

| | | |
|---|---|---|
| CA | 2333936 | 12/1999 |

*Primary Examiner* — Louis Casaregola
*Assistant Examiner* — Phutthiwat Wongwian
(74) *Attorney, Agent, or Firm* — Norton Rose Canada LLP

(57) ABSTRACT

A combustor for a gas turbine engine includes an annular combustor shell having an inner liner and an outer liner respectively with inner and outer flanges at least partly overlapping to form a dome end portion of the shell, at least the outer flange including intersecting upstream and downstream wall portions defining a corner therebetween, the upstream wall portion having a plurality of cooling apertures defined therethrough immediately upstream of the corner, and the cooling apertures being oriented to direct a cooling air flow from outside the combustor shell therethrough and adjacent an inner surface of the downstream wall portion.

18 Claims, 3 Drawing Sheets

U.S. PATENT DOCUMENTS

| | | | | |
|---|---|---|---|---|
| 5,307,637 | A | 5/1994 | Stickles et al. | |
| 5,335,502 | A | 8/1994 | Roberts, Jr. et al. | |
| 5,398,509 | A | 3/1995 | North et al. | |
| 5,407,133 | A | 4/1995 | Liang | |
| 5,479,782 | A | 1/1996 | Parker et al. | |
| 5,590,531 | A | 1/1997 | Desaulty et al. | |
| 5,816,041 | A | 10/1998 | Greninger | |
| 5,956,955 | A | 9/1999 | Schmid | |
| 5,996,351 | A | 12/1999 | Feitelberg et al. | |
| 6,079,199 | A | 6/2000 | McCaldon et al. | |
| 6,105,371 | A | 8/2000 | Ansart et al. | |
| 6,253,538 | B1 | 7/2001 | Sampath et al. | |
| 6,408,629 | B1 | 6/2002 | Harris et al. | |
| 6,427,446 | B1 | 8/2002 | Kraft et al. | |
| 6,497,105 | B1 | 12/2002 | Stastny | |
| 6,546,733 | B2 | 4/2003 | North et al. | |
| 6,553,767 | B2 | 4/2003 | Farmer et al. | |
| 6,606,861 | B2 | 8/2003 | Snyder | |
| 6,651,437 | B2 | 11/2003 | Farmer et al. | |
| 6,675,582 | B2 | 1/2004 | Monty et al. | |
| 6,711,900 | B1 * | 3/2004 | Patel et al. | 60/752 |
| 6,751,961 | B2 | 6/2004 | Pacheco-Tougas et al. | |
| 6,810,672 | B2 | 11/2004 | Coutandin | |
| 6,810,673 | B2 | 11/2004 | Snyder | |
| 7,269,958 | B2 | 9/2007 | Stastny | |
| 7,308,794 | B2 | 12/2007 | Morenko et al. | |
| 2006/0042263 | A1 | 3/2006 | Patel | |
| 2007/0006588 | A1 | 1/2007 | Patel | |
| 2007/0271925 | A1 * | 11/2007 | Alkabie et al. | 60/772 |

* cited by examiner

COMBUSTOR WITH CHAMFERED DOME

TECHNICAL FIELD

The present invention relates generally to gas turbine engine combustors and, more particularly, to an improved combustor construction.

BACKGROUND OF THE ART

Cooling of gas turbine sheet metal combustor walls is typically achieved by directing cooling air through holes in the combustor wall to provide effusion and/or film cooling. These holes may be provided as machined cooling rings positioned around the combustor or effusion cooling holes in a sheet metal liner. Opportunities for improvement are continuously sought, however, to improve both cost and cost effectiveness.

SUMMARY OF THE INVENTION

It is the object of the present invention to provide an improved gas turbine combustor.

In accordance with one aspect of the present invention, there is provided a gas turbine engine combustor comprising an annular combustor shell having an inner liner and an outer liner defining therebetween an annular combustion chamber, the inner and outer liners being discrete and respectively having inner and outer flanges at least partly overlapping to form a dome end portion of the combustor shell, said inner and outer flanges being physically fastened together such as to fix said inner liner and said outer liner in position relative to each other at said dome end portion, at least the outer flange including intersecting first and second wall portions defining a first corner therebetween, the first wall portion being located upstream of the second wall portion and the second wall portion being connected to a remainder of the outer liner through a second corner, the first wall portion having a plurality of cooling apertures defined therethrough immediately upstream of the first corner, the cooling apertures being oriented to direct a cooling air flow from outside the combustor shell therethrough and adjacent an inner surface of the second wall portion.

In accordance with another aspect of the present invention, there is provided a split combustor shell for a gas turbine engine comprising an inner liner and an outer liner defining an annular combustion chamber therebetween, the inner and outer liners having overlapping end dome portions fastened to each other to retain the split combustor shell together, the end dome portion of at least the outer liner including at least two smooth continuous wall portions intersecting each other at a discontinuity, the two smooth continuous wall portions defining an upstream wall and a downstream wall relative to the discontinuity, inner surfaces of the two smooth continuous wall portions defining an obtuse inner angle therebetween at the discontinuity, the upstream wall having a plurality of apertures defined therethrough immediately adjacent the discontinuity, the apertures being defined to deliver pressurized air surrounding the combustor shell through the upstream wall and along the inner surface of the downstream wall of the end dome portion.

In accordance with a further aspect of the present invention, there is provided a gas turbine engine combustor comprising a sheet metal combustor shell including an inner liner and an outer liner radially spaced apart and defining an annular combustion chamber therebetween, the inner and outer liners being fastened together at an annular dome end of the combustor shell, the dome end including overlapping outer and inner flanges of the outer and inner liners respectively, and at least the outer flange of the outer liner having a chamfered profile including two wall portions intersecting each other at a first corner formed therebetween, the two wall portions including an upstream wall and a downstream wall relative to the first corner, the first corner defining an obtuse angle between inner adjacent surfaces on either side thereof, at least the upstream wall having a plurality of apertures defined therethrough immediately adjacent to and upstream of the first corner, the apertures being oriented to deliver pressurized air surrounding the combustor shell through the upstream wall of the outer flange and along the inner surface of the downstream wall.

Further details of these and other aspects of the present invention will be apparent from the detailed description and Figures included below.

DESCRIPTION OF THE DRAWINGS

Reference is now made to the accompanying Figures depicting aspects of the present invention, in which.

DETAILED DESCRIPTION OF PREFERRED EMBODIMENTS

Figure 1:
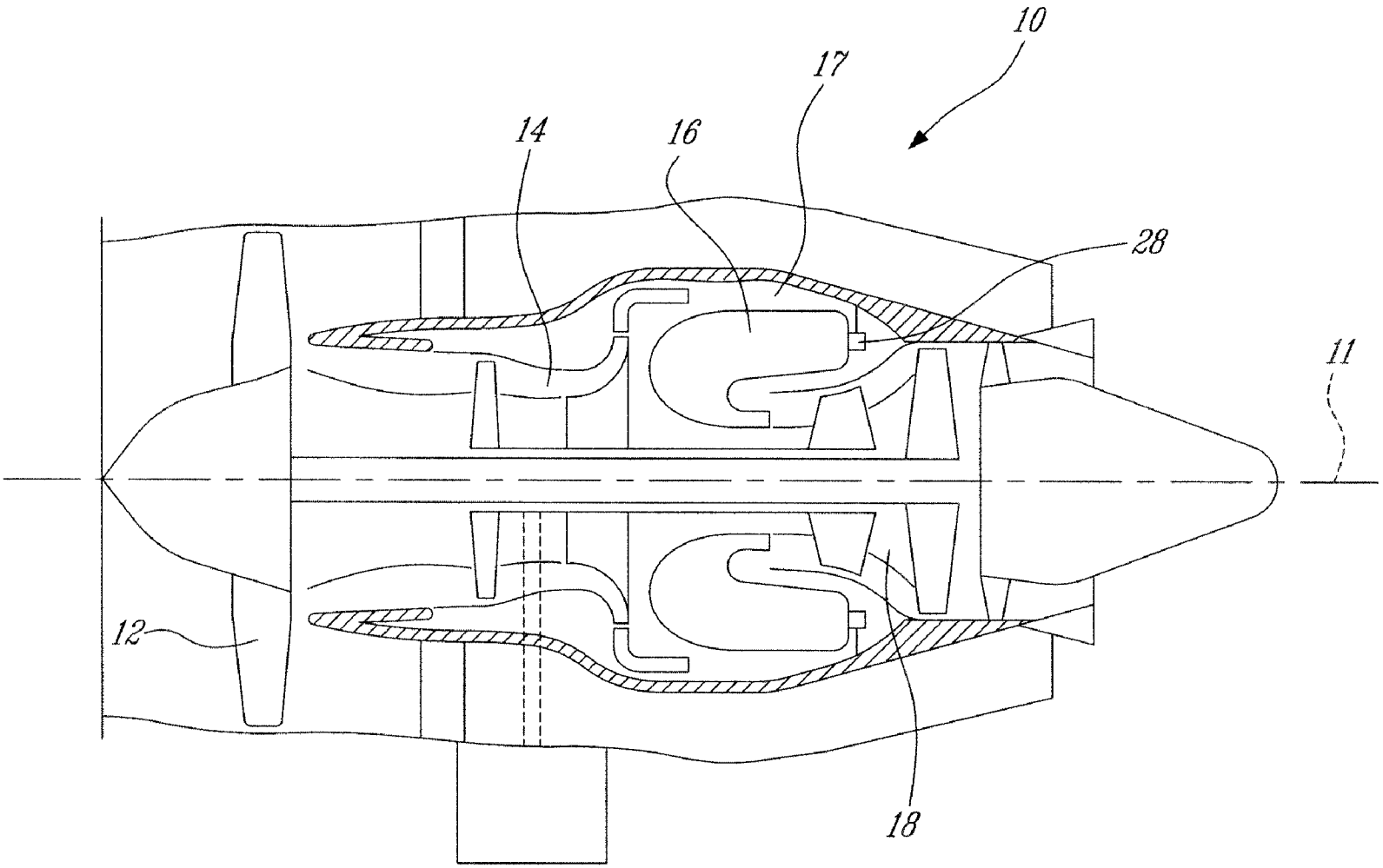
FIG. 1 shows a schematic partial cross-section of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
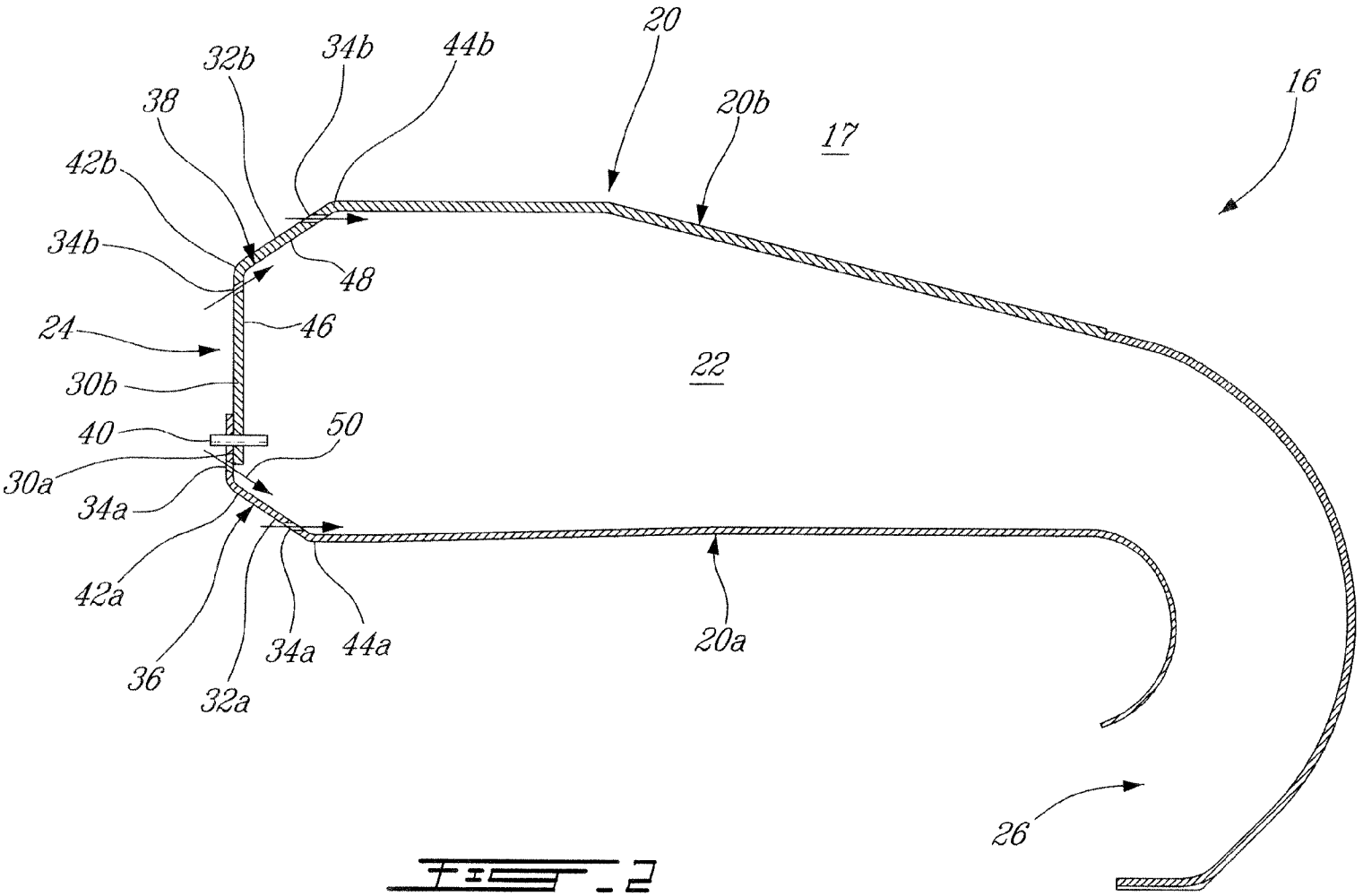
FIG. 2 shows a partial cross-section of a reverse flow annular combustor of a gas turbine engine having a dome portion in accordance with one aspect of the present invention.

The combustor 16 is housed in a plenum 17 supplied with compressed air from the compressor 14. As shown in FIG. 2, the combustor 16 comprises an annular combustor shell 20 composed of a radially inner liner 20*a* and a radially outer liner 20*b*, which are typically made out of a single ply of sheet metal and which define a combustion chamber 22. The combustor 16 has a bulkhead or inlet dome portion 24 and an opposed exit portion 26 for communicating with the turbine section 18. As shown in FIG. 1, a plurality of fuel nozzles 28 are mounted to the inlet dome end portion 24 of the combustor 16 to deliver a fuel-air mixture to the chamber 22. In use, compressed air from the plenum 17 enters combustion chamber 22 through a plurality of holes (discussed further below) and mixed with fuel injected though the nozzles 28 to be ignited. Hot combusted gases are then directed forward through the combustion chamber 22, which redirects the flow aft towards a high pressure turbine (not shown).

As shown in FIG. 2, the inner and outer liners 20*a*, 20*b* are bent at one end thereof to respectively form a first flange 36 and a second flange 38 at the end face of the combustor dome portion 24. Radial wall portions of the first and second flanges 36, 38 overlap each other so as to form at least part of the end wall of the dome portion 24. The first and second flanges 36, 38 are physically fastened together such as to fix them in position relative to each other, for example through a series of removable fasteners 40.

In an alternate embodiment (not shown), the flanges 36, 38 overlap along at least a substantial part of the dome portion 24, and are fixedly secured together by a plurality of circumferentially distributed dome heat shields mounted inside the combustion chamber 22 to protect the end wall of the dome 24 from the high temperatures in the combustion chamber 22 around the fuel nozzles 28.

In a particular embodiment and as depicted by arrow 50, the overlapping flanges 36, 38 are not perfectly sealed at their interface thereby providing for air leakage from the plenum 17 into the combustion chamber 22. The air leakage from the inner and outer liners overlapped flanges 36, 38 advantageously provides additional film cooling on the inner and outer liners 20*a*, 20*b*, and as such perfectly mating machined surfaces for the flanges 36, 38 are not required.

Cooling of the inner and outer liners 20*a*, 20*b* is non-exclusively provided by a plurality of cooling apertures 34*a*, 34*b*, which permit fluid flow communication between the outer surrounding air plenum 17 and the combustion chamber 22 defined within the combustor shell 20.

In the embodiment shown, each flange 36, 38 includes a radial wall portion 30*a*, 30*b* and an angled wall portion 32*a*, 32*b*, with at least part of the radial wall portions 30*a*, 30*b* overlapping one another and being interconnected, as described above. Each flange 36, 38 thus includes a "corner" or apex 42*a*, 42*b* interconnecting the radial and angled portions 30*a*, 30*b* and 32*a*, 32*b*, and another corner 44*a*, 44*b* interconnecting each angled portion 32*a*, 32*b* to a remainder of the respective liner 20*a*, 20*b*. Each corner 42*a*, 42*b*, 44*a*, 44*b* is defined by a discontinuity or relatively "sharp" intersection between the adjacent portions of the respective liner 20*a*, 20*b*, and defines an inner angle between adjacent inner surfaces of the liner 20*a*, 20*b*, for example the inner wall surfaces indicated 46 and 48 in FIG. 2. The inner angles are preferably, although not necessarily, obtuse and defined between about 100° and about 170°, but more preferably between about 130° and about 150°. However, it is to be understood that other angles may also be used, whether acute or obtuse, and may range from less than 45 degrees up to 179 degrees. For example, the inner liner 120*a* of the combustor 120 shown in FIG. 3 has a substantially perpendicular corner 144*a* with the dome which defines a very slight angle of about 88 degrees to the vertical.

The chamfer of the flanges 36, 38 created by the angled portions 32*a*, 32*b* of the flanges 36, 38 advantageously add strength to the shell 20, making the shell 20 less susceptible to deformation during use. The chamfers thus act as stiffeners by adding a conical section between the vertical walls of the dome 24 and the cylindrical section of the liners 20*a*, 20*b*. Certain combustor configurations, for example which include heat shields at the dome end of the combustor, can also cause thermal gradients between the hotter liner walls and the cooler dome walls. The conical sections created by the chamfered flanged 36, 38 act as a stiffener and provides angles for drilling holes parallel to the inner walls of the liners to enhance cooling. Thus deformation is reduced by a combination of managing thermal gradients and local stiffening of the walls adjacent to the vertical section of the dome wall.

In addition, the relatively sharp bends created by the corner or apexes 42*a*, 42*b*, 44*a*, 44*b* defined in the combustor shell 20 act to help maximize cooling within the combustion chamber 22. The corners 42*a*, 42*b*, 44*a*, 44*b* help the gas flow to turn relatively sharply and follow the inner surface of the liners 20*a*, 20*b*. Thus, by cooling this same region using the cooling apertures 34*a*, 34*b*, described in greater detail below, to inject lower temperature cooling air jets, overall cooling of the combustion gas flow is maximized. As such, a cooling film is provided and stabilized on the inner surfaces of the shell 20.

A plurality of cooling apertures 34*a*, 34*b* are defined in the combustor wall immediately upstream of, and locally adjacent, each corner 42*a*, 42*b*, 44*a*, 44*b*. The cooling apertures 34*a*, 34*b* are adapted to direct cooling air from the plenum 17 through the respective liner 20*a*, 20*b* and thereafter adjacent and generally parallel the surface downstream of the corner 42*a*, 42*b*, 44*a*, 44*b* (e.g. the inner surface 48 of the respective angled portion 32*a*, 32*b* in the case of the corners 42*a*, 42*b*) such as to cool the liner 20*a*, 20*b*. The cooling apertures 34*a*, 34*b* may be provided by any suitable means, however laser drilling is preferred. The cooling apertures 34*a*, 34*b* are preferably formed such that they extend parallel to the wall portion downstream of the corner 42*a*, 42*b*, 44*a*, 44*b*. However, it is to be understood that a small angular deviation from this parallel configuration of the apertures may be necessary for manufacturing reasons. However, an angular deviation away from parallel preferably should not exceed 6 degrees, i.e. 3 degrees nominal, +/−3 degrees. If laser drilling is employed, the laser beam used to cut the cooling aperture through the sheet metal wall could potentially scratch or scar the downstream wall surface. Therefore, such a small angular deviation away from parallel may be desirable to avoid damage nearby wall portions of the shell 20.

The combustor shell 20 may include additional cooling means, such as a plurality of effusion cooling holes throughout the liners 20*a*, 20*b*.

Figure 3:
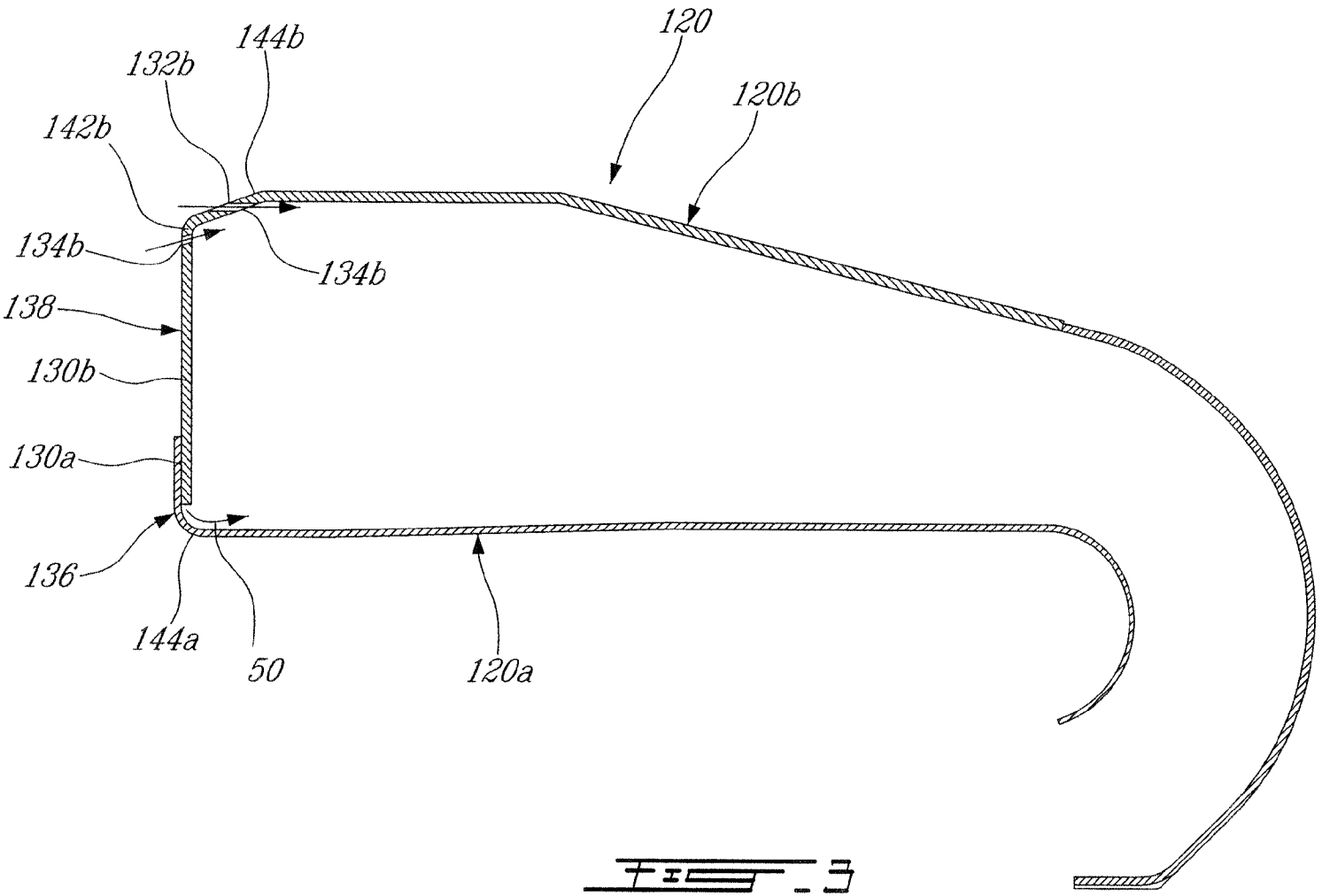
FIG. 3 shows a partial cross-section of a reverse flow annular combustor of a gas turbine engine having a dome portion in accordance with another aspect of the present invention.

Referring now to FIG. 3, an alternate configuration for the combustor shell 120 is shown. In this embodiment, the flange 136 of the inner liner 120*a* only includes a radial portion 130*a*, i.e. the radial portion 130*a* is directly connected to the remainder of the inner liner 120*a* through a substantially perpendicular corner 144*a*, with the angled portion of the previous embodiment being omitted. The flange 138 of the outer liner 120*b*, like in the previous embodiment, includes a radial portion 130*b* and an angled portion 132*b* interconnected by a first corner 142*b*, the angled portion 132*b* being connected to the remainder of the outer liner 120*b* through a second corner 144*b*. Each of the corners 142*b*, 144*b* of the outer liner 120*b* defines an inner obtuse angle. Cooling apertures 134*b* are defined in the outer liner 120*b* upstream of the corners 142*b*, 144*b* and preferably aligned generally parallel to the wall portion downstream of the corners 142*b*, 144*b*, such that cooling air passing therethrough is directed in a film substantially along the inner surface of said wall parallel thereto.

In both embodiments, the surfaces on either side of the corners are preferably "flat" or "smooth" in the sense that they are a simple and single (i.e. linear) surface of revolution about the combustor axis (not shown, but which is an axis coincident with, or at least parallel to, the engine axis 11 shown in FIG. 1.) Alternately, the wall surfaces on either side of the corners may comprise curved surfaces. However, it is generally more cost and time efficient, and therefore preferable, to manufacture flat walls when possible. The surfaces on either side of the corners in the embodiments shown are all frustoconical or planar. These surfaces on either side of the corners are preferably "continuous" in the sense that they are free from surface discontinuities such as bends, steps, kinks, etc.

It is to be understood that the term "sharp" is used loosely herein to refer generally to a non-continuous (or discontinuous) transition from one defined surface area to another. Such "sharp" corners will of course be understood by the skilled reader to have such a radius of curvature as is necessary or prudent in manufacturing same. However, this radius of curvature is preferably relatively small, as a larger radius will increase the length of the corner portion between the upstream and downstream surface areas, which tends to place most of the bend into a region which receives less cooling effect from the cooling air apertures defined upstream thereof.

Although a single circular array of cooling aperture is depicted upstream of each corner, it is to be understood that any particular configuration, number, relative angle and size of apertures may be employed.

The above description is therefore meant to be exemplary only, and one skilled in the art will recognize that further changes may be made to the embodiments described without departing from the scope of the invention disclosed. Modifications will be apparent to those skilled in the art, in light of a review of this disclosure, and such modifications are intended to fall within the appended claims.

The invention claimed is:

1. A gas turbine engine combustor comprising an annular combustor shell having a single wall inner liner and a single wall outer liner defining therebetween an annular combustion chamber, the inner and outer liners being discrete and respectively having inner and outer flanges at least partly overlapping to form a dome end portion of the combustor shell, said inner and outer flanges being physically fastened together such as to fix said inner liner and said outer liner in position relative to each other at said dome end portion, at least the outer flange including intersecting first and second wall portions defining a first corner therebetween, the first wall portion being located upstream of the second wall portion and the second wall portion being connected to a remainder of the outer liner through a second corner, the first wall portion extending at least substantially radially inwardly from the first corner and overlapping the inner flange, the second wall portion being frustoconical, the first wall portion having a plurality of cooling apertures defined therethrough immediately upstream of the first corner, the cooling apertures being oriented to direct a cooling air flow from outside the combustor shell therethrough at an angle such that the airflow is injected from the first wall portion following a direction having a radially outward component and along an inner surface of the second wall portion.

2. The combustor as defined in claim 1, wherein the second wall portion has a plurality of additional cooling apertures defined therethrough immediately upstream of the second corner, the additional cooling apertures being oriented to direct a cooling air flow from outside the combustor shell therethrough and adjacent an inner surface of the remainder of the outer liner.

3. The combustor as defined in claim 1, wherein the inner flange includes intersecting third and fourth wall portions defining a third corner therebetween, the third wall portion being located upstream of the fourth wall portion and the fourth wall portion being connected to a remainder of the inner liner through a fourth corner, the third wall portion having a plurality of cooling apertures defined therethrough immediately upstream of the third corner, the cooling apertures being oriented to direct a cooling air flow from outside the combustor shell therethrough and adjacent an inner surface of the fourth wall portion.

4. The combustor as defined in claim 3, wherein the fourth wall portion has a plurality of additional cooling apertures defined therethrough immediately upstream of the fourth corner, the additional cooling apertures being oriented to direct a cooling air flow from outside the combustor shell therethrough and adjacent an inner surface of the remainder of the inner liner.

5. The combustor as defined in claim 1, wherein the first and second wall portions are smooth continuous wall portions.

6. The combustor as defined in claim 1, wherein the cooling apertures are defined through the first wall portion substantially parallel to the second wall portion.

7. The combustor as defined in claim 1, wherein the first wall portion is fastened to the inner liner.

8. A split combustor shell for a gas turbine engine comprising an inner liner and an outer liner defining an annular combustion chamber therebetween, the inner and outer liners having overlapping end dome portions fastened to each other to retain the split combustor shell together, the end dome portion of at least the outer liner including at least two smooth continuous single wall portions intersecting each other at a discontinuity, the two smooth continuous single wall portions defining an upstream wall and a downstream wall relative to the discontinuity, the upstream wall extending at least substantially radially inwardly from the discontinuity to overlap the inner liner, the downstream wall being frustoconical, inner surfaces of the two smooth continuous wall portions defining an obtuse inner angle therebetween at the discontinuity, the upstream wall having a plurality of apertures defined therethrough immediately adjacent the discontinuity, the apertures being oriented such as to deliver pressurized air surrounding the combustor shell through the upstream wall following a direction having a radially outward component and along the inner surface of the downstream wall of the end dome portion.

9. The combustor as defined in claim 8, wherein the discontinuity provides a sharp corner.

10. The combustor as defined in claim 8, wherein the downstream wall intersects a remainder of the outer liner at an additional discontinuity, the downstream wall having a plurality of additional apertures defined therethrough immediately adjacent the additional discontinuity, the additional apertures being defined to deliver pressurized air surrounding the combustor shell through the downstream wall and along an inner surface of the remainder of the outer liner.

11. The combustor as defined in claim 8, wherein the end dome portion of the inner liner includes at least two smooth continuous wall portions intersecting each other at a second discontinuity, the two smooth continuous wall portions of the inner liner defining an upstream wall and a downstream wall relative to the second discontinuity, inner surfaces of the two smooth continuous wall portions of the inner liner defining an obtuse inner angle therebetween at the second discontinuity, the upstream wall of the inner liner having a plurality of second apertures defined therethrough immediately adjacent the second discontinuity, the second apertures being defined to deliver pressurized air surrounding the combustor shell through the upstream wall of the inner liner and along the inner surface of the downstream wall of the end dome portion of the inner liner.

12. The combustor as defined in claim 11, wherein the downstream wall of the inner liner intersects a remainder of the inner liner at a third discontinuity, the downstream wall of the inner liner having a plurality of third apertures defined therethrough immediately adjacent the third discontinuity, the third apertures being defined to deliver pressurized air surrounding the combustor shell through the downstream wall of the inner liner and along an inner surface of the remainder of the inner liner.

13. The combustor as defined in claim 8, wherein the apertures are defined through the upstream wall substantially parallel to the downstream wall.

14. The combustor as defined in claim 8, wherein the upstream wall is fastened to the inner liner.

15. A gas turbine engine combustor comprising:

a sheet metal combustor shell including an inner liner and an outer liner radially spaced apart and defining an annular combustion chamber therebetween, the inner and outer liners being fastened together at an annular dome end of the combustor shell, the dome end including overlapping outer and inner flanges of the outer and inner liners respectively and being defined by a single wall on each side of the overlapping flanges; and at least the outer flange of the outer liner having a chamfered profile including two wall portions intersecting each other at a first corner formed therebetween, the two wall portions including an upstream wall and a downstream wall relative to the first corner, the upstream wall extending at least substantially radially inwardly from the first corner and overlapping the inner flange, the downstream wall being frustoconical, the first corner defining an obtuse angle between inner adjacent surfaces on either side thereof, at least the upstream wall having a plurality of apertures defined therethrough immediately adjacent to and upstream of the first corner, the apertures being oriented to direct pressurized air surrounding the combustor shell through the upstream wall of the outer flange following a direction having a radially outward component and along the inner surface of the downstream wall.

16. The combustor as defined in claim 15, wherein the two wall portions are smooth continuous wall portions.

17. The combustor as defined in claim 15, wherein the two wall portions are rectilinear.

18. The combustor as defined in claim 15, wherein the downstream wall intersects a remainder of the outer liner at second corner, the downstream wall having a plurality of additional apertures defined therethrough immediately adjacent to and upstream of the second corner, the additional apertures being oriented to deliver pressurized air surrounding the combustor shell through the downstream wall of the outer flange and along an inner surface of the remainder of the outer liner.

* * * * *